US010132015B2

(12) United States Patent
Woodruff et al.

(10) Patent No.: US 10,132,015 B2
(45) Date of Patent: Nov. 20, 2018

(54) NON-KINKING WRAPPABLE KNIT SLEEVE AND METHOD OF CONSTRUCTION THEREOF

(71) Applicant: FEDERAL-MOGUL POWERTRAIN LLC, Southfield, MI (US)

(72) Inventors: Alexa A. Woodruff, Bryn Mawr, PA (US); Cassie M. Malloy, Trappe, PA (US)

(73) Assignee: Federal-Mogul Powertrain, LLC, Southfield, MI (US)

( * ) Notice: Subject to any disclaimer, the term of this patent is extended or adjusted under 35 U.S.C. 154(b) by 5 days.

(21) Appl. No.: 15/837,383

(22) Filed: Dec. 11, 2017

(65) Prior Publication Data

US 2018/0100255 A1 Apr. 12, 2018

Related U.S. Application Data

(62) Division of application No. 14/627,462, filed on Feb. 20, 2015, now Pat. No. 9,840,793.

(60) Provisional application No. 61/942,473, filed on Feb. 20, 2014.

(51) Int. Cl.

| | |
|---|---|
| ***D04B 21/20*** | (2006.01) |
| ***D04B 21/14*** | (2006.01) |
| ***D04B 1/22*** | (2006.01) |
| *D04B 1/14* | (2006.01) |

(52) U.S. Cl.

CPC ..... *D04B 21/14* (2013.01); *D04B 1/225* (2013.01); *D04B 21/205* (2013.01); *D04B 1/14* (2013.01); *D10B 2403/0311* (2013.01); *D10B 2505/12* (2013.01); *Y10T 428/13* (2015.01)

(58) Field of Classification Search

CPC ..... D04B 21/06; D04B 21/08; D04B 21/16; D04B 21/20; D04B 21/205; D04B 21/14; D04B 21/225

See application file for complete search history.

(56) References Cited

U.S. PATENT DOCUMENTS

| | | | | |
|---|---|---|---|---|
| 4,100,770 A * | 7/1978 | Titone | D04B 21/18 | 66/193 |
| 4,500,578 A * | 2/1985 | van de Kamp | B66C 1/18 | 428/102 |
| 4,733,545 A * | 3/1988 | Weinle | D04B 21/18 | 66/193 |
| 5,178,923 A * | 1/1993 | Andrieu | A44B 18/0069 | 428/100 |

(Continued)

*Primary Examiner* — Danny Worrell

(74) *Attorney, Agent, or Firm* — Robert L. Stearns; Dickinson Wright, PLLC

(57) ABSTRACT

A warp knit textile sleeve is provided. The sleeve has an elongate, wrappable wall extending along a longitudinal axis between opposite ends. The wall has opposite free edges extending lengthwise along the longitudinal axis between the opposite ends. The wall is knit from at least one warp yarn extending lengthwise between the opposite ends and a plurality of weft yarns extending circumferentially between the opposite free edges. The weft yarns form a plurality of discrete, annular bands alternating in adjacent relation along the longitudinal axis. The weft yarn of one of the adjacent bands has a first diameter and the weft yarn of the other of the adjacent bands has a second diameter, wherein the first diameter is less than the second diameter.

20 Claims, 3 Drawing Sheets

(56) References Cited

U.S. PATENT DOCUMENTS 5,191,777 A * 3/1993 Schnegg ..... D04B 21/165 66/190
5,522,240 A * 6/1996 Wall ..... D04B 21/18 66/170
5,843,542 A * 12/1998 Brushafer ..... F16L 11/02 428/36.1
6,145,879 A * 11/2000 Lowe ..... B60R 21/20 280/743.1
6,328,080 B1 * 12/2001 Winters ..... D03D 19/00 138/168
6,711,920 B2 * 3/2004 Akers ..... F16L 57/04 138/123
6,984,596 B2 * 1/2006 Dickerson ..... B32B 5/10 245/1
7,216,678 B2 * 5/2007 Baer ..... D03D 3/08 139/383 R
7,690,225 B2 * 4/2010 Relats ..... F16L 11/02 66/170
8,322,168 B2 * 12/2012 Wall ..... D04B 21/18 66/193
8,505,339 B2 8/2013 Malloy et al.
8,701,716 B2 * 4/2014 Kashihara ..... D03D 1/0041 139/384 R
8,925,592 B2 * 1/2015 Itoh ..... B60R 16/02 138/123
9,347,158 B2 * 5/2016 Cabouillet ..... D04H 1/52
9,388,515 B2 * 7/2016 Goulet ..... B29C 63/0021
9,416,469 B2 * 8/2016 Woodruff ..... D03D 3/02
2003/0044155 A1 * 3/2003 Maiden ..... D03D 3/02 385/137
2004/0003630 A1 * 1/2004 Akers ..... F16L 59/029 66/197
2005/0124249 A1 * 6/2005 Uribarri ..... D04B 21/20 442/304
2007/0163305 A1 * 7/2007 Baer ..... D04B 21/16 66/171
2008/0135119 A1 * 6/2008 Tonooka ..... D03D 3/02 138/110
2011/0275268 A1 * 11/2011 Harris ..... H02G 3/0481 442/319
2012/0037263 A1 * 2/2012 Malloy ..... D03D 3/00 139/387 R
2012/0328810 A1 * 12/2012 Relats Casas ..... F16L 57/06 428/36.1
2014/0273699 A1 * 9/2014 Zhang ..... D04B 21/14 442/316
2015/0093556 A1 * 4/2015 Woodruff ..... H02G 3/0481 428/213
2015/0176162 A1 * 6/2015 Relats Manent ..... D04B 21/16 66/195
2015/0233029 A1 * 8/2015 Woodruff ..... D04B 21/14 428/34.1

* cited by examiner

FIG. 1
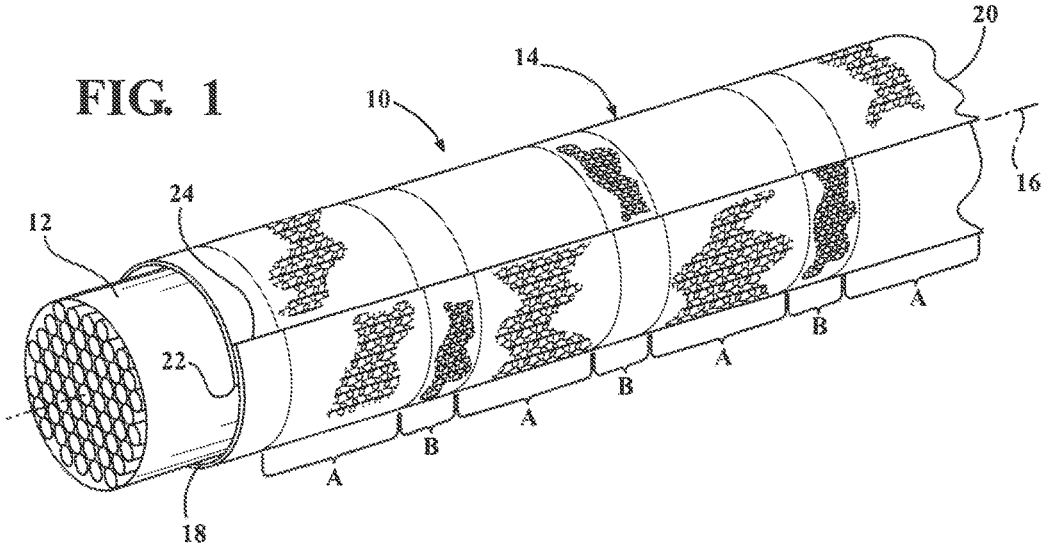
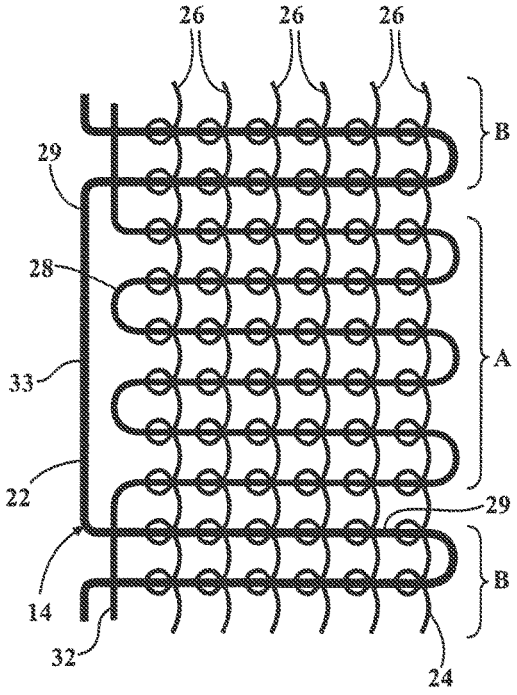
FIG. 2A
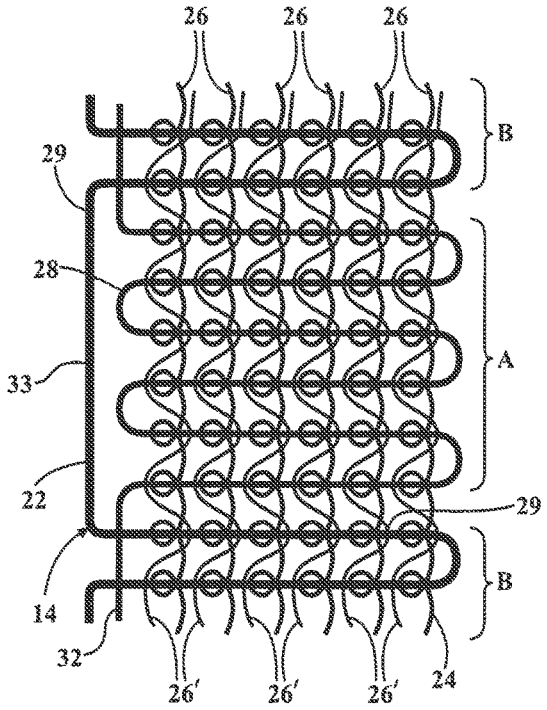
FIG. 2B

NON-KINKING WRAPPABLE KNIT SLEEVE AND METHOD OF CONSTRUCTION THEREOF

CROSS-REFERENCE TO RELATED APPLICATION

This U.S. Divisional Application claims the benefit of U.S. Utility application Ser. No. 14/627,462, filed Feb. 20, 2015 and U.S. Provisional Application Ser. No. 61/942,473, filed Feb. 20, 2014, each of which are incorporated herein by reference in their entirety.

BACKGROUND OF THE INVENTION

1. Technical Field

This invention relates generally to knit wrappable protective textile sleeves for protecting elongate members.

2. Related Art

It is known to utilize textile sleeves to protect elongate members from a variety of external environmental conditions, including braided, knit or woven textile sleeves. Knit sleeves can either be formed having a seamless, tubular wall, or an open, wrappable wall having opposite lengthwise extending edges configured to overlap one another. Wrappable knit sleeves are typically constructed with relatively stiff weft monofilament yarns along the full, uninterrupted length of the sleeve (also referred to as fill yarns) that extend widthwise, circumferentially about the wall to provide the sleeve with high hoop strength, thereby inhibiting the sleeve from being crushed or flattened. Unfortunately, although knit sleeves having stiff weft yarns attain high hoop strength, they have limited flexibility along their length, thereby inhibiting the ability to route the sleeves about circuitous, meandering paths, and if bent too much, cause the sleeve wall to open along a seam between the overlapping edges and/or kink. In some cases, in order to provide a more flexible sleeve when increased flexibility is necessary to route the sleeve over a meandering path, knit wrappable sleeves are fabricated along their entire, uninterrupted length from multifilament weft yarns having an increased flexibility, or entirely from very fine, small diameter weft monofilaments; however, these sleeves, although having an increased flexibility, suffer from having a greatly reduced hoop strength, and thus, are prone to being easily crushed or flattened in use, thereby subjecting the elongate members being protected therein to damage.

Woven sleeves can be similarly constructed as discussed above, namely, including either relatively stiff weft monofilament yarns, or smaller, more flexible monofilament yarns, or more flexible multifilament yarns, however, the same drawbacks are encountered as discussed above, namely, having a high hoop strength with greatly limited flexibility, or an increased flexibility with a greatly reduced hoop strength. In addition, in weaving constructions, if the weft yarn is laid in, also referred to as inserted, the construction is less stable in that the laid in weft yarn is generally free to move, both relative to one another and to the warp yarn. As such, both the construction process can become complicated as a result of yarns having moved from their intended position, and the end product can have unintended, undesirable openings between yarns, thereby resulting in a less than optimal coverage being provided to the enclosed members being protected.

Accordingly, what is needed is a textile sleeve that combines the benefits of a high hoop strength and flexibility, thereby providing protection against being crushed, while at the same time, being flexible and non-kinking when routed over circuitous, meandering paths, including around corners of 90 degrees or more. Furthermore, what is needed is a sleeve that maintains structural integrity throughout the entire manufacturing process, while also having yarns that remain in their intended position to provide optimal protective coverage, in use.

SUMMARY OF THE INVENTION

In accordance with one aspect of the invention, a wrappable textile sleeve is provided. The wrappable textile sleeve includes an elongate, wrappable wall extending along a longitudinal axis between opposite ends. The wall has opposite free edges extending lengthwise along the longitudinal axis between the opposite ends. The wall is knit from at least one warp yarn extending lengthwise between the opposite ends and a plurality of weft yarns extending circumferentially between the opposite free edges. The weft yarns form a plurality of discrete, annular bands alternating in adjacent relation along the longitudinal axis. The weft yarn of one of the adjacent bands has a first diameter and the weft yarn of the other of the adjacent bands has a second diameter, wherein the first diameter is less than the second diameter.

In accordance with another aspect of the invention, the weft yarns are laid-in and fixed in position by the at least one warp yarn.

In accordance with another aspect of the invention, the at least one warp yarn can be knit having closed chain stitches looped about the weft yarns.

In accordance with another aspect of the invention, the at least one warp yarn can be knit having open chain stitches looped partially about the weft yarns.

In accordance with another aspect of the invention, the weft yarn of one of the adjacent bands floats along the longitudinal axis over the weft yarn of the other of the adjacent bands.

In accordance with another aspect of the invention, the weft yarn in every other band can be provided having the same diameter.

In accordance with another aspect of the invention, the weft yarn in every other band can be knit as a single, continuous, monolithic strand of yarn.

In accordance with another aspect of the invention, each of the weft yarns is inserted in a plurality of said bands.

In accordance with another aspect of the invention, the respective ratio of the first diameter to the second diameter of the weft yarns can be provided between about 1:1.5 to 1:2.

In accordance with another aspect of the invention, the wall has an outer surface and further an outer layer can be laminated to the outer surface.

In accordance with another aspect of the invention, at least one of the weft yarns can be heat-set to bias the opposite free edges into overlapping relation with one another.

In accordance with another aspect of the invention, the at least one warp yarn can be provided as a multifilament.

In accordance with another aspect of the invention, the at least one warp yarn can include a plurality of warp yarns, at least some of the warp yarns being knit having chain stitches, and at least some of the warp yarns being laid-in.

In accordance with another aspect of the invention, the plurality of bands adjacent one another can include three or more bands having weft yarns of differing diameters from one another, thereby providing an alternating sequence of bands, such as A, B, C . . . A, B, C . . . A, B, C . . . A, B, C, wherein each of the bands A, B, C . . . have weft yarns of differing diameters from one another.

In accordance with another aspect of the invention, the adjacent bands can include different weft yarn types from one another, such that some of the bands can. include solely monofilament weft yarns, while others of the bands can includes solely multifilament weft yarns, or different bands can include different combinations of monofilament weft yarns and multifilament weft yarns.

In accordance with another aspect of the invention, a method of constructing a wrappable textile sleeve is provided. The method includes warp knitting an elongate wall from at least one lengthwise extending warp yarn extending along a longitudinal axis between opposite ends and a plurality of circumferentially extending weft yarns extending circumferentially between opposite free edges extending lengthwise between the opposite ends. Further, forming a plurality of discrete, circumferentially extending, annular hands extending between the opposite edges with the weft yarns during the warp knitting process, with adjacent bands being formed with weft yarns having different diameters from one another.

In accordance with another aspect of the invention, the method can further include laying-in the weft yarns and fixing the weft yarns in position with the at least one warp yarn.

In accordance with another aspect of the invention, the method can further include knitting at least some of the warp yarn using a chain stitch.

In accordance with another aspect of the invention, the method can further include laying-in at least some of the warp yarn.

In accordance with another aspect of the invention, the method can further include forming floats with the weft yarns, the floats extending along the longitudinal axis from one band, over an adjacent band.

In accordance with another aspect of the invention, the method can further include laying-in the weft yarn in every other band from a single, continuous, monolithic strand of yarn.

In accordance with another aspect of the invention, the method can further include laying-in each of the weft yarns in a plurality of the bands.

In accordance with another aspect of the invention, the method can further include providing the first diameter and the second diameter of the weft yarns having a respective ratio of about 1:1.5 to 1:2.

In accordance with another aspect of the invention, the method can further include bonding an outer layer on the warp knit wall.

In accordance with another aspect of the invention, the method can further include heat-setting at least one of the weft yarns to bias the opposite free edges into overlapping relation with one another.

In accordance with another aspect of the invention, the method can further include providing the at least one warp yarn as a multifilament.

In accordance with another aspect of the invention, the method can further include providing the plurality of weft yarns as one of a monofilament, multifilament, or a combination thereof.

In accordance with another aspect of the invention, the method can further include forming each of the bands of smaller first diameter yarns extending over an increased axial length of the sleeve wall relative to each of the bands of larger second diameter yarns.

The knit, wrappable sleeve constructed in accordance with the invention provides the desired protection to elongate members contained therein, while also having an enhanced degree of flexibility to allow the sleeve to be routed about corners of 90 degrees or more without kinking, as well as having an enhanced structural integrity compared to that of a woven sleeve. The enhanced flexibility is provided by alternating the adjacent, discrete bands of weft yarn with one another. The bands with weft yarns having an increased diameter relative to the adjacent bands provide enhanced hoop strength to the wall of the sleeve. Meanwhile, the bands with weft yarns having a reduced diameter, relative to the adjacent bands, provide enhanced flexibility to the sleeve wall, while at the same time also being able to impart a heat-set bias on the sleeve wall, if at least some of the weft yarns within these bands are heat-set. The enhanced structural integrity is provided by having the warp yarns at least partially looped about the weft yarns, thereby fixing the weft yarns in position, though the weft yarns are laid-in. Accordingly, the sleeve provides reliable protection to the elongate member contained therein without fear of kinking and having inadvertent openings formed along the overlapped edges, and without fear of the knit yarns inadvertently moving out of their intended locations relative to one another.

BRIEF DESCRIPTION OF THE DRAWINGS

These and other aspects, features and advantages of the present invention will become more readily appreciated when considered in connection with the following detailed description of presently preferred embodiments and best mode, appended claims and accompanying drawings, in which:

FIG. 1 is a schematic perspective view of a knit, wrappable sleeve constructed in accordance with one aspect of the invention shown wrapped about an elongate member;

FIGS. 2A-2D illustrate enlarged partial plan views of various knit stitch patterns used to construct a wall of the sleeve of FIG. 1 in accordance with various embodiments of the invention;

DETAILED DESCRIPTION OF PRESENTLY PREFERRED EMBODIMENTS

Figure 2C:
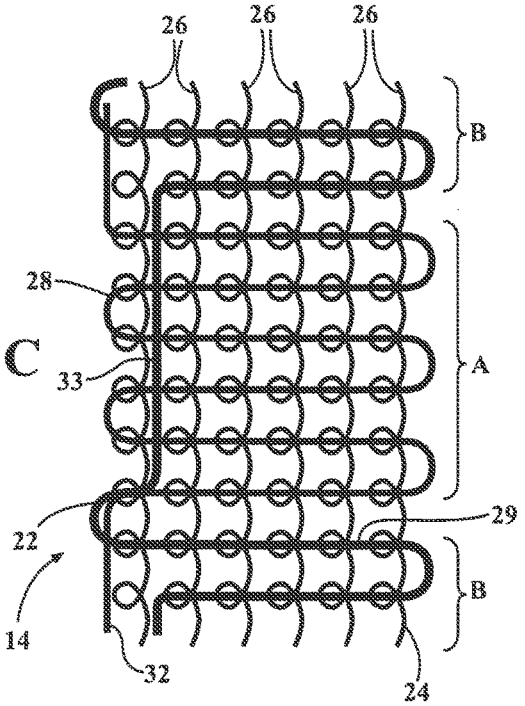

Referring in more detail to the drawings, FIG. 1 illustrates a warp knit textile sleeve 10 constructed in accordance with one aspect of the invention wrapped about an elongate member 12 (e.g. flexible cable or wire harness or other flexible member) to be protected. The sleeve 10 has an elongate wall 14 that extends along a longitudinal axis 16 between opposite ends 18, 20 with lengthwise extending opposite free edges 22, 24 extending parallel or substantially parallel to the longitudinal axis 16 between the opposite ends 18, 20. As best shown in FIGS. 2A-2D, in accordance with different respective embodiments of the invention, the wall 14 is warp knit including lengthwise extending warp yarns 26 and circumferentially extending weft yarns, shown here by way of example and without limitation as a pair of differently sized weft yarns 28, 29. The weft yarns 28, 29 are knit to form a plurality of adjacent discrete annular hands, shown by way of example and without limitation as first and second hands, represented respectively by A, B, that alternate with one another along the length of the sleeve 10. The bands A, B have respective widths w1, w2 that extend along the longitudinal axis 16, wherein the widths w1, w2 are of individual, axially extending lengths to provide the desired flexibility and hoop strength to the sleeve 10, without necessarily sacrificing one of flexibility and hoop strength over the other. What distinguishes the bands A, B from one another are the diameters, and possibly yarn type (i.e. monofilament versus multifilament) of the respective weft yarns 28, 29 used to form the bands A, B, wherein the immediately adjacent bands A, B have weft yarns of different diameters from one another. The bands A are knit consisting entirely of the weft yarns 28 having a diameter no greater than a first diameter, while the bands B are knit entirely with the weft yarns 29 having a second diameter that is greater than the first diameter. As such, the bands A, B of the sleeve 10 are formed having different physical properties from one another, wherein the different physical properties alternate along the length of the sleeve 10. The differing physical properties are directly attributable to the different diameters, and possibly yarn types, of the weft yarns 28, 29 used to form the respective bands A, B. The bands A are knit with smaller first diameter weft yarns 28, such as from monofilaments, multifilaments, or a combination thereof, to provide the sleeve 10 with enhanced flex regions that result in an enhanced ability of the sleeve 10 to flex and bend around corners, including corners of 90 degrees or more, without kinking and without forming openings or gaps between the overlapping edges 22, 24. Meanwhile, the bands B are knit with larger second diameter weft yarns 29, such as from monofilaments, multifilaments, or a combination thereof, to provide the sleeve 10 with relatively stiff, relatively rigid regions relative to the bands A, thereby providing the wall 14 with enhanced hoop strength to prevent the wall 14 from being flattened or crushed under a radially applied force. As such, the elongate member 12 contained within the sleeve 10 is able to be routed about corners as desired as a result of the relatively flexible bands A, while also being protected against damage from being crushed as a result of the increased hoop strength bands B.

The warp yarn 26 can be provided of any suitable yarn material, including monofilament and/or multifilament yarn, and in any suitable number of ends, depending on the overall construction of the sleeve, as discussed further below. To enhance coverage protection provided by the wall 14 to the enclosed elongate member 12, the warp yarn 26 can be provided at least in part, or entirely, of multifilament yarn.

The weft yarns 28, 29 can be provided solely as monofilament yarn, or as a combination of monofilament and multifilament yarn, and can be provided at least in part as heat-settable monofilament yarn, if desired to facilitate heat-setting the wall 14 into a thermally formed, self-wrapping wall. The alternating bands A, B, as discussed above, have differently sized weft yarns from one another, whether provided solely as monofilaments or as a combination of monofilament and multifilament yarn, thereby providing the sleeve 10 with increased flex bands A including the smaller diameter yarn having a relatively high level of flexibility, and increased hoop strength bands B including the larger diameter yarn having a relatively low level of flexibility and a relative high hoop strength compared to bands A. In accordance with one embodiment of the invention, wherein the sleeve 10 is a "standalone" structure, and thus, does not have any layers other than the knit wall 14, the weft yarns 28 in the flexible bands A and the weft yarns 29 in the more rigid bands B have a respective ratio of diameters of about 1:1.5. In any case, the bands A, B are sized in axially extending widths relative with one another to provide the desired amount of flex and hoop strength, while at the same time preventing the wall 14 from kinking and forming openings gaps along the seam between the overlapping edges 22, 24. If the relative widths of the bands A, B is not maintained, the wall 14 can either sacrifice the needed hoop strength, such as if the bands A are too wide relative to the bands B, or the wall can be too stiff and inflexible, thereby kinking and forming openings/gaps along the seam between the edges 22, 24, such as if the bands B are too wide relative to the bands A. Accordingly, it should be recognized that a balance needs to he maintained between the respective widths of the bands A, B to provide the sleeve 10 with the ability to flex without kinking and forming openings/gaps, while also retaining the desired hoop strength without being too stiff.

Figure 4:
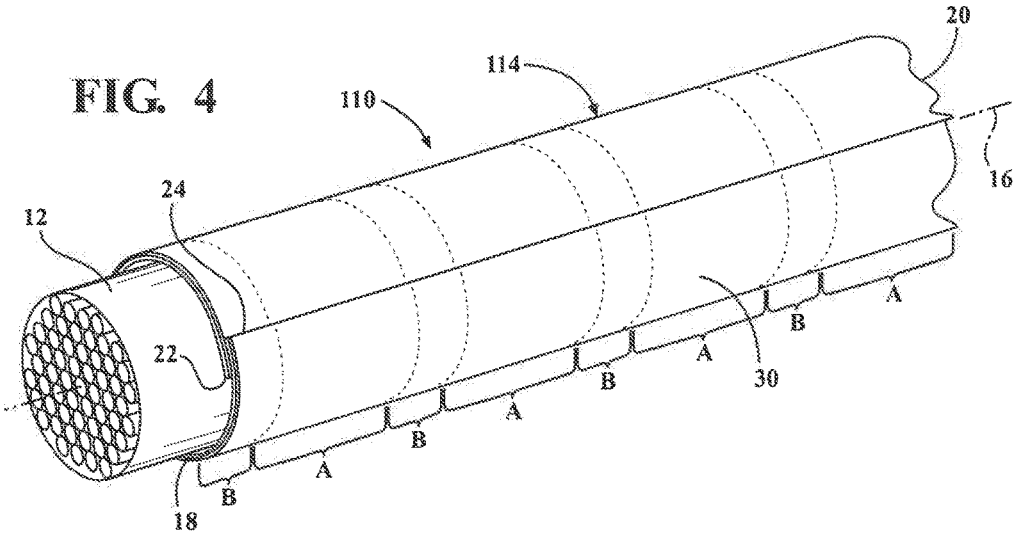
FIG. 4 is a view similar to FIG. 1 of a knit, wrappable sleeve constructed in accordance with another aspect of the invention shown wrapped about an elongate member.

If the sleeve 10 is intended to be used as a "standalone" sleeve, thereby being free of any additional layers, then the wall 14 is knit having a relatively high density of yarns in both the warp and weft directions. Otherwise, as shown in an alternate embodiment of the invention in FIG. 4, wherein the same reference numerals, offset by a factor of 100, are used to identify like features, a sleeve 110 has an outer layer 30 bonded to the wall 114, such as a layer of foil 30, by way of example, then the density of the warp yarn should be significantly reduced from that for the standalone sleeve 10 shown in FIG. 1, such as between about 25-50% less warp ends than the sleeve 10 not having an additional layer, by way of example. The reduced density of the warp yarn 26 in the sleeve 110 allows the sleeve 110 to remain flexible without causing the foil layer 30 to tear, while also avoiding the unwanted increase in bulk. It should be recognized the sleeve 110 has knit bands A, B similarly as discussed for the wall 14, wherein relatively small diameter weft yarns 28 are knit in the flexible bands A and relatively large diameter weft yarns 29 are knit in the more rigid bands B, such that the ratio of the respective weft yarns 28, 29 is preferably about 1:2.

In the FIGS. 2A-2D, various knit stitch patterns are shown in accordance with different knit embodiments. In FIG. 2A, each warp yarn 26 is warp knit in a closed chain stitch (pillar stitch) with the weft yarns 28, 29, thereby forming loops that are looped entirely about the weft yarns 28, 29, while the weft yarns 28, 29 alternate with one another along the lengthwise direction to form the discrete bands A, B, with the weft yarns 28, 29 being laid-in with the knit warp yarns 26. The bands A, B of the weft yarns 28, 29 alternate in lengthwise relation with one another as a result of respective floats 32, 33 of each weft yarn 28, 29 that float or skip along the longitudinal axis 16 over the weft yarn of the immediately adjacent band to form the next band on an opposite side of the immediately adjacent band. Accordingly, the floats 32 of the weft yarn 28 forming the bands A float over the adjacent bands B, while the floats 33 of the weft yarn 29 forming the hands B float over the adjacent bands A. It should be recognized that the plurality of bands A are formed via at least one, continuous, monolithic strand of weft yarn 28, while the bands B are formed via at least one, continuous, monolithic strand of yarn 29.

In FIG. 2B, the knit structure is similar to that of FIG. 2A, however, additional warp yarns 26' are laid-in between the closed chain stitch warp yarns 26 to provide added coverage to the wall.

In FIG. 2C, the knit structure is similar to that of FIG. 2A, however, rather than the floats 32, 33 of the weft yarns 28, 29 being exposed along the edges 22, 24, the floats 32 extend inwardly from the edges 22, 24, and thus, are essentially hidden to form a "clean", smooth edge with no exposed monofilaments in the float regions.

Figure 2D:
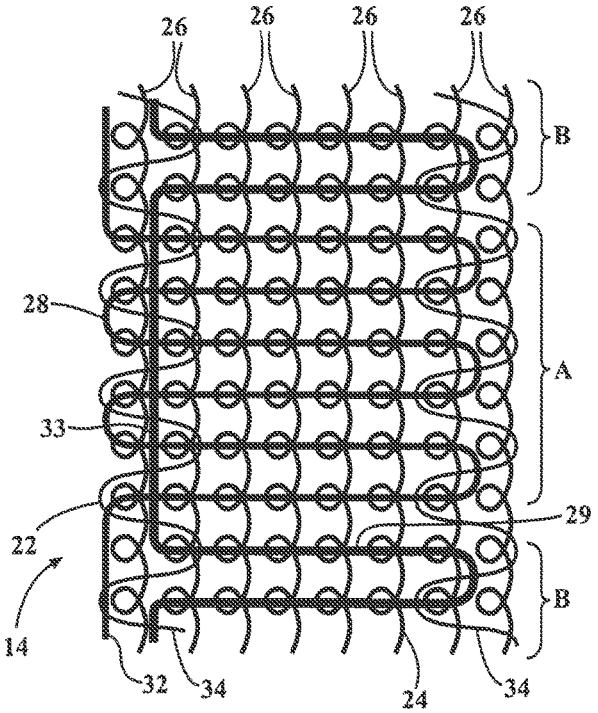

In FIG. 2D, as with FIG. 2C, again the floats 32, 33 are hidden, and so too is the entirety of the weft yarns 28, 29 along the edges 22, 24. This results from the incorporation of laid-in warp inserts 34 along the edges 22, 24 in combination with warp knit ends 26, shown knit in a closed chain stitch, with the laid-in warp inserts 34.

Figure 3:
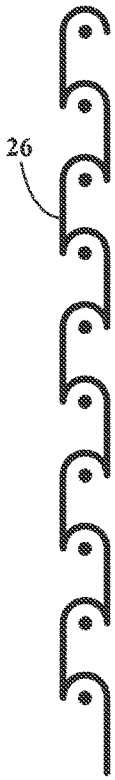
FIG. 3 is a knit stitch diagram of an open pillar stitch that can be used in the construction of a sleeve constructed in accordance with another embodiment of the invention.

The embodiments shown in FIGS. 2A-2D are shown with the warp ends 26 being knit in a closed chain stitch, extending in looped fashion entirely about the weft yarns 28, 29 to fix the weft yarns 28, 29 in position, however, additional embodiments of the invention can be knit with warp ends 26 in an open chain stitch, as shown in FIG. 3, wherein the warp ends 26 extend at least partially about the weft yarns 28, 29 to fix the weft yarns 28, 29 in position.

Figure 5:
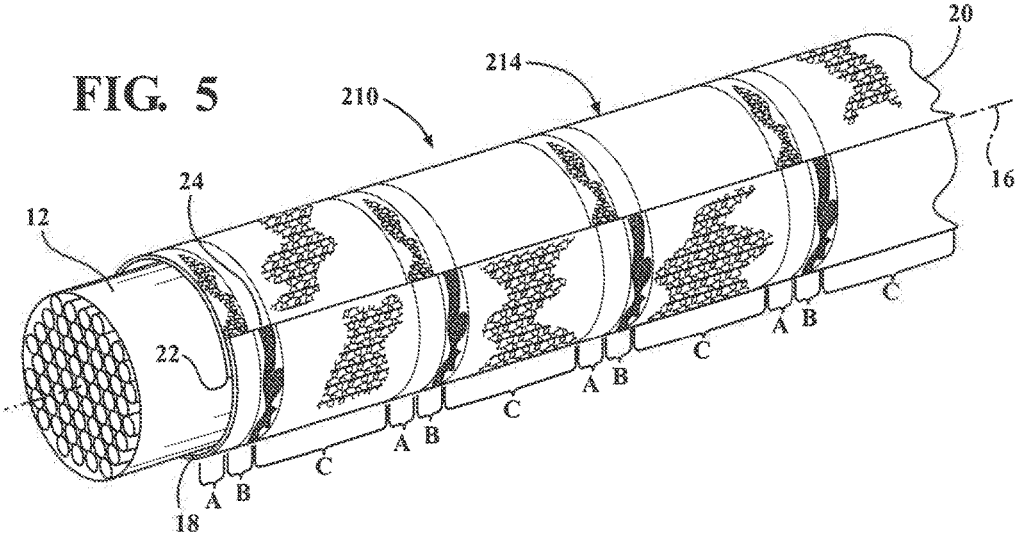
FIG. 5 is a view similar to FIG. 4 of a knit, wrappable sleeve constructed in accordance with yet another aspect of the invention shown wrapped about an elongate member.

FIG. 5 shows a sleeve 210 constructed in accordance with another aspect of the invention, wherein the same reference numerals, offset by a factor of 200, are used to identify like features as discussed above. The sleeve 210 has a wall 214 constructed as above, having a plurality of bands adjacent one another to provide the desired flexibility and hoop strength, however, rather than only having a pair of different band types A, B, the sleeve has three or more different types of alternating bands A, B, C . . . . Accordingly, the sleeve 210 includes a plurality of bands adjacent one another, wherein the bands adjacent one another have weft yarns of differing diameters from one another, thereby providing an alternating sequence of hands, such as A, B, C . . . A, B, C . . . A, B, C . . . A, B, C, wherein each of the bands A, B, C . . . have weft yarns of differing diameter from one another. It should also be recognized that adjacent bands A, B, C can include different types of weft yarns from one another, such that one band could include only monofilament weft yarn, while and adjacent band could include only multifilament yarn or a combination of monofilament and multifilament yarns, by way of example and without limitation. Ultimately, the number of different types of bands and different types of weft yarn used will be driven by the performance characteristics desired for the intended protective sleeve application.

Many modifications and variations of the present invention are possible in light of the above teachings. It is, therefore, to be understood that the invention may be practiced otherwise than as specifically described, and that the scope of the invention is defined by any ultimately allowed claims.

What is claimed is:

1. A wrappable textile sleeve, comprising:

an elongate, wrappable wall extending along a longitudinal axis between opposite ends, said wall having opposite free edges extending lengthwise along said longitudinal axis between said opposite ends, said wall being knit from at least one warp yarn extending lengthwise between said opposite ends and a plurality of weft yarns extending circumferentially between said opposite free edges, said weft yarns form a plurality of discrete, annular, adjacent bands alternating along said longitudinal axis, wherein the weft yarn of one of said adjacent bands has a first diameter and the weft yarn of the other of said adjacent bands has a second diameter, said first diameter being less than said second diameter.

2. The wrappable textile sleeve of claim 1 wherein said weft yarns are laid-in and fixed in position by said at least one warp yarn.

3. The wrappable textile sleeve of claim 2 wherein said at least one warp yarn has closed chain stitches looped about said weft yarns.

4. The wrappable textile sleeve of claim 2 wherein said at least one warp yarn has open chain stitches looped partially about said weft yarns.

5. The wrappable textile sleeve of claim 2 wherein said weft yarn of each of said bands forms floats along said longitudinal axis, said floats extending over a plurality of said weft yarn of an adjacent band.

6. The wrappable textile sleeve of claim 5 wherein said weft yarn in every other band is the same diameter.

7. The wrappable textile sleeve of claim 6 wherein said weft yarn in every other band share a single, continuous, monolithic strand of yarn.

8. The wrappable textile sleeve of claim 1 wherein each of said weft yarns is inserted in a plurality of said bands.

9. The wrappable textile sleeve of claim 1 wherein the respective ratio of said first diameter to said second diameter is between about 1:1.5 to 1:2.

10. The wrappable sleeve of claim 1 wherein said wall has an outer surface and further comprising an outer layer laminated on said outer surface.

11. The wrappable sleeve of claim 10 wherein said outer layer is foil.

12. The wrappable textile sleeve of claim 10 wherein the respective ratio of said first diameter to said second diameter is about 1:1.5.

13. The wrappable textile sleeve of claim 1 wherein at least one of said weft yarns is heat-set to bias said opposite free edges into overlapping relation with one another.

14. The wrappable textile sleeve of claim 1 wherein said at least one warp yarn is a multifilament.

15. The wrappable textile sleeve of claim 14 wherein said plurality of weft yarns are monofilaments.

16. A wrappable textile sleeve, comprising:

an elongate, wrappable wall extending along a longitudinal axis between opposite ends, said wall having opposite free edges extending lengthwise along said longitudinal axis between said opposite ends, said wall being knit from at least one warp yarn extending lengthwise between said opposite ends and a plurality of weft yarns extending circumferentially between said opposite free edges, said weft yarns form a plurality of discrete, annular bands alternating along said longitudinal axis, wherein the weft yarn of one of said adjacent bands has a first diameter and the weft yarn of the other of said adjacent bands has a second diameter, said first diameter being less than said second diameter; and wherein said at least one warp yarn includes a plurality of warp yarns, at least some of said warp yarns be knit having chain stitches, and at least some of said warp yarns being laid-in.

17. The wrappable textile sleeve of claim 1 wherein at least some of the bands including the weft yarn having the first diameter extend over a longer axial length of the wall relative to at least some of the bands including the weft having the second diameter.

18. The wrappable textile sleeve of claim 17 wherein each of the bands including the weft yarn having the first diameter extend over a longer axial length of the wall relative to each of the bands including the weft having the second diameter.

19. The wrappable textile sleeve of claim 1 wherein each of the bands including the weft yarn having the first diameter include a plurality of passes of the first diameter weft yarn extending in a weft-wise direction between the opposite free edges in adjacent, axially spaced relation with one another, and each of the bands including the weft yarn having the second diameter include a plurality of passes of the second diameter weft yarn extending in a weft-wise direction between the opposite free edges in adjacent, axially spaced relation with one another.

20. The wrappable textile sleeve of claim 19 wherein each of the bands including the weft yarn having the first diameter share a single, common weft yarn and each of the bands including the weft yarn having the second diameter share a single, common weft yarn.

* * * * *